US005608174A

United States Patent [19]

Eck et al.

[11] Patent Number: 5,608,174

[45] Date of Patent: Mar. 4, 1997

[54] CHROMIUM-BASED ALLOY

[76] Inventors: Ralf Eck, Hühnersteig 1; Günter Kneringer, Kaiser-Lothar-Strasse 40; Wolfgang Köck, Ehrenbergstrasse 43, A-6600, all of A-6600 Reutte, Austria

[21] Appl. No.: 440,693

[22] Filed: May 15, 1995

Related U.S. Application Data

[63] Continuation of Ser. No. 57,985, May 4, 1993, abandoned.

[30] Foreign Application Priority Data

May 14, 1992 [AT] Austria ..... 981/92

[51] Int. Cl.[6] ..... C22C 1/04; C22C 1/10

[52] U.S. Cl. ..... 75/235; 75/243; 75/244; 75/245

[58] Field of Search ..... 75/235, 243, 244, 75/245; 419/20, 58, 28, 29

[56] References Cited

U.S. PATENT DOCUMENTS

| | | | |
|---|---|---|---|
| 3,017,265 | 1/1962 | McGurty et al. | 420/40 |
| 3,027,252 | 3/1962 | McGurty et al. | 420/40 |
| 3,138,457 | 6/1964 | Edwards | 420/428 |
| 3,174,853 | 3/1965 | Sims et al. | 420/428 |
| 3,227,548 | 1/1966 | Clark | 420/428 |
| 3,347,667 | 10/1967 | Wukusick et al. | 420/428 |
| 3,591,362 | 7/1971 | Benjamin | 428/570 |
| 3,787,202 | 1/1974 | Mueller et al. | 420/428 |
| 3,816,111 | 6/1974 | Schneider | 420/428 |
| 3,841,847 | 10/1974 | Jones et al. | 420/428 |
| 3,874,938 | 4/1975 | Benjamin et al. | 148/428 |
| 3,909,309 | 9/1975 | Bomford | 419/20 |
| 3,999,985 | 12/1976 | Jones et al. | 420/428 |
| 4,428,778 | 1/1984 | Masuda et al. | 148/11.5 P |
| 5,126,106 | 6/1992 | Hidaka et al. | 420/428 |
| 5,302,181 | 4/1994 | Morichika et al. | 75/245 |

FOREIGN PATENT DOCUMENTS

| | | |
|---|---|---|
| 1608116 | 12/1970 | Germany . |
| 2105750 | 8/1972 | Germany . |
| 2303802 | 8/1973 | Germany . |
| 2258946 | 10/1990 | Japan . |

OTHER PUBLICATIONS

English–language Abstract of German Patent No. DE 2105750.

English–language Abstract of German DE 2303802.

English–language translation of Abstract from German Patent Disclosure No. 1608116.

*Primary Examiner*—Ngoclan Mai

*Attorney, Agent, or Firm*—Morgan & Finnegan, L.L.P.

[57] ABSTRACT

The invention relates to a chromium-based alloy which has a chromium content of more than 65% by weight and the following composition: 0.005 to 5% by weight of one or more oxides of the rare earth elements and 0.1 to 32% by weight of one or more metals selected from the group comprising iron, nickel and cobalt, the remainder being chromium.

The alloy may furthermore contain up to 30% by weight of one ore more metals selected from the group comprising Al, Ti, Zr and Hf, up to 10% by weight of one or more metals selected from the group comprising V, Nb, Mo, Ta, W and Re and up to 1% by weight of C and/or N and/or B and/or Si.

Compared with pure chromium the alloy has a substantially improved oxidation resistance and improved corrosion resistance, in particular with respect to vanadium pentoxide.

11 Claims, No Drawings

CHROMIUM-BASED ALLOY

This is continuation of application Ser. No. 08/057,985, filed on May 4, 1993, now abandoned Priority of application Ser. No. 981/92, filed May 14, 1992 in Austria is claimed under 35 U.S.C. §119.

1. Field of the Invention

The invention relates to a chromium-based alloy.

2. Background

Pure chromium having a purity of 99.97%, which is currently technically possible, is widely used where good corrosion resistance is important. However, it has the disadvantage that, depending on the preparation process, it recrystallizes at relatively low temperatures between 700° C. and 800° C. and, hence, does not permit an increase in strength by working, as is usually the case for such metallic materials.

A significant disadvantage of pure chromium is the brittleness of the material, which sets in as a rule below about 400° C., depending on the working process. Thus, the use of the material in practice is often permitted only by more expensive production and construction procedures.

In the past, therefore, attempts have been made to reduce the ductile/brittle transition temperature of chromium, without losing its good corrosion resistance, by alloying the chromium with other elements. These attempts have not been satisfactorily achieved to date.

German Offenlegungsschrift 1,608,116 describes a chromium alloy which contains up to 45% by weight of iron and/or nickel and/or cobalt, and up to a total of 5% by weight of Al, Ti, Zr, Hf, V, Nb, Ta, Mo, W, Y and rare earth elements, and up to 1% by weight of C, N, b and Si. This alloy is intended to increase the oxidation resistance and corrosion resistance of chromium and to improve the ductility at low temperatures, in particular by alloying with iron as well as with nickel and cobalt. In addition, it is intended to considerably reduce the ductile/brittle transition temperature by the addition of Al, Ti, Zr, Hf, V, Nb, Ta and Y and rare earth elements. However, the ductile/brittle transition temperature of this alloy is still too high, so that this alloy has not achieved any practical significance.

German Offenlegungsschrift 2,105,750 relates to a casting comprising a chromium-based alloy which consists either of a single crystal or of a plurality of oriented crystals. The alloy preferably contains 5–50% by weight of iron and/or cobalt and/or nickel, 1–25% by weight of niobium and/or tantalum and/or molybdenum and/or tungsten and/or rhenium, up to 2% by weight of Y and/or rare earth elements and/or aluminum, and up to 1% by weight of boron and/or carbon and/or nitrogen and/or silicon in conjunction with added amounts of boride-, carbide-, nitride- or silicide-forming metals.

This prior publication too states that a ductile/brittle transition temperature of about several hundred degrees °C. lower than the value at that time, and a relatively high notched impact strength at room temperature, can be achieved by this alloy in the single-crystal state. The prior publication provides no information on the corrosion resistance and oxidation resistance of this alloy. The disadvantage of this alloy is, in particular, that as a cast alloy, it is no longer mechanically workable so that not all workpieces can be produced in the desired dimensions. In particular, the production of semi-finished products, such as sheets, rods and wire, is not possible.

U.S. Pat. Nos. 3,591,362 and 3,874,938, and German Auslegeschrift 2,303,802, describe in general terms dispersion-hardened metal alloys which may contain up to 25% by volume of a dispersoid, including oxides of the rare earth metals. The claims describe a chromium contents of the alloy of up to 65% by weight. However, the examples and the description disclose that the invention applies primarily to alloys having a substantially lower chromium contents, in particular to ODS superalloys having a chromium content of between about 10 and 20% by weight.

U.S. Pat. No. 3,909,309 describes a process for improving the flexural strengths of ODS superalloys. In a subclaim, chromium contents of up to 65% by weight are mentioned. Here too, however, the examples show that the practical chromium content of ODS superalloys is substantially lower, about 20% by weight.

ODS superalloys are used primarily in the construction of hot-gas turbines, where good corrosion resistance with respect to vanadium pentoxide is not so important. The dispersoids are added primarily for increasing the strength properties of the alloy.

U.S. Pat. No. 3,841,847 discloses a chromium-based alloy which contains at least 70% by weight of chromium and may contain up to 18% by weight of yttrium oxide in addition to yttrium, aluminum and silicon. In this alloy too, the ductile/brittle transition temperature is still very high so that the production of semifinished products a parts by working processes is problematic.

3. OBJECT OF THE INVENTION

It is the object of the present invention to provide a chromium-based alloy which has good corrosion resistance, in particular to combustion gases and non-volatile combustion residues of fossil fuels, and which simultaneously possesses a ductile/brittle transition temperature sufficiently low for working processes and good heat stability properties.

4. SUMMARY OF THE INVENTIONS

According to the invention, object is achieved by a chromium-base alloy which has a chromium content of more than 65% by weight and, in addition to conventional impurities, consists of 0.005–5% by weight of one or more oxides of the rare earth elements and 0.1 to 32% by weight of one or more metals selected from the group comprising iron, nickel and cobalt.

5. DETAILED DESCRIPTION OF THE INVENTION

In the case of various alloys, it is known that oxides of the rare earth elements are added to increase the heat stability by dispersion hardening. Completely surprising, however, was the discovery that, in the case of a chromium-based alloy having a chromium content of more than 65% by weight, a certain content of oxides of the rare earth elements in the alloy with simultaneous alloying of a certain amount of iron, nickel and/or cobalt results in improved resistance to oxidation and reduced corrosion, in particular with respect to vanadium pentoxide, which is formed in a large amount in the combustion of fossil fuels. At the same time, the ductile/brittle transition temperature is reduced so that the workability of the chromium alloy at low temperatures and also the ductility when used at low temperatures are improved.

Below a content of 0.005% by weight, the addition of rare earth oxides has virtually no effect. The upper limit for their addition is 5% by weight, since amounts over and above this result in a deterioration in the workability of the alloy to an unacceptable extent.

It is only above a minimum content of 0.1% by weight that the alloy elements iron, nickel and cobalt display their ductility-imparting effect on the alloy, whereas, when the upper limit of 32% by weight is exceeded, the corrosion properties of the alloy are adversely affected to such an extent that an alloy of this type is virtually of no further interest.

The use of yttrium oxide and/or lanthanum oxide as oxides of the rare earth elements in an amount of 0.5 to 2% by weight, and of iron and nickel in an amount of 5 to 25% by weight, has proven particularly advantageous.

The alloy according to the invention is suitable in particular as a material for stationary as well as moving parts in all plants in which temperatures of about 800° C. to above 1200° C. occur and in which there is contact with gases and residues from combustion, in particular of fossil fuels, and with pure or contaminated air at the same time.

In addition to the wide-ranging corrosion resistance, the alloy according to the invention has high heat stability, a high recrystallization temperature, and a coefficient of thermal expansion which is substantially better adapted to other high-temperature materials such as, for example, ceramic, compared with known chromium alloys, thereby further extending the range of use of the alloy according to the invention.

The optional inclusion of up to 30% by weight of one or more metals selected from the group consisting of aluminum, titanium, zirconium and hafnium, primarily results in the further improvement the oxidation resistance of the alloy. Aluminum and/or titanium and/or zirconium in an amount of 3 to 10% by weight of the alloy have proven particularly suitable elements.

By the optional inclusion of up to 10% by weight of one or more metals selected from the group consisting of vanadium, niobium, molybdenum, tantalum, tungsten and rhenium, the dimensional stability at high temperatures is increased in components consisting of the alloy according to the invention, which is important especially in the case of the occurrence of long-lasting stresses which affect the components. The light and ductility-imparting metals vanadium and niobium are preferred. The addition of the high-melting metals tungsten and rhenium may reduce the oxidation resistance of the alloy, and they are therefore advantageously used only in relatively small amounts. Vanadium, niobium and molybdenum, individually or in combination, in a total content of 3 to 8% by weight of the alloy, have proven particularly advantageous.

For applications in which the strength is to be further increased for a temperature range above 1000° C., it is advantageous to alloy up to 1% by weight of carbon and/or nitrogen and/or boron and/or silicon with the chromium alloy. These elements, forming hard phases, increase the strength of the alloy without adversely affecting the good corrosion property of the alloy and without substantially reducing the ductility. It is particularly advantageous here to use carbon and/or nitrogen in an amount of 0.03 to 0.3% by weight of the alloy.

In an advantageous powder metallurgical process for the preparation of the alloy according to the invention, the mixture of the starting powder is compressed to a minimum density of 65% and the compact is sintered at a sinter temperature between 1500° and 1600° C. under an H2 atmosphere for 15 to 20 hours.

The invention is illustrated in detail below with reference to examples.

PREPARATION EXAMPLE

For the production of sheet metal from the alloy Cr-4Fe-5Ti-1$Y_2O_3$, the following were milled in an attritor for 12 hours under argon at a pressure of one atmosphere: 60 kg of a powder mixture comprising 4% by weight of iron powder having a mean particle size of 26 μm, 5% by weight of titanium hydride powder having a mean particle size of 2 μm, and 1% by weight of $Y_{23}$ powder having a mean particle size of 0.35 μm, the remainder being chromium powder having a mean particle size of 30 μm. The powder mixture was then subjected to cold isostatic pressing at a pressure of 3000 bar in a steel die to give plates measuring 80 mm×300 mm×40 mm. These plates were then sintered without presintering at 1600° C. for 20 hours under hydrogen. Thereafter, the sintered plates were canned on all sides into steel sheet having a thickness of 2 mm.

After initial heating to 1250° C., the canned plates were worked by forging by 35% and were cooled from the final forging temperature in the furnace to room temperature in the course of 12 hours. After initial heating to 1250° C., the plates were rolled to give 4.5 mm thick sheets and were cooled from the final rolling temperature in the furnace to room temperature in the course of 12 hours. The sheets were then heated to 1250° C. and further rolled to a thickness of 2 mm, and the edges were trimmed. Immediately thereafter, the sheets were again heated to 1250° C. and annealed for one hour at this temperature. After cooling to 500° C., the sheets were finally rolled to a thickness of 1.3 mm and then subjected to final annealing at 1600° C. for one hour.

In addition, 1.3 mm thick sheets of the following alloys, a) Cr - 0.15 Fe - 1 $Y_2O_3$ b) Cr - 0.15 Fe - 1 $La_2O_3$ c) Cr - 24 Fe - 5 Al - 1 $Y_2O_3$, and d) of pure chromium were also produced using the same production steps and production conditions. In the case of the aluminum-containing alloys, aluminum powder having a mean particle size of 28 μm was used.

Testing of the Corrosion Resistance

To test the corrosion resistance of alloys produced according to the invention, in comparison with pure chromium with respect to vanadium pentoxide, samples measuring 100 mm×100 mm were cut from the sheets produced according to the preparation example. The samples were then ground on both sides to a final thickness of 1 mm with removal of the superficial steel layers.

After being weighed, the samples were exposed to the combustion slag in the body of an oil furnace at 900° C. for 3 hours. The samples were then cooled, washed with water and weighed again. The following average weight losses were found as a measure of the corrosion in each case:

| Material | Weight Loss (mg/cm$^2$) |
|---|---|
| Chromium | 3.7 |
| Cr-4 Fe-5 Ti-1 $Y_2O_3$ | 1.8 |
| Cr-0.15 Fe-1 $Y_2O_3$ | 2.4 |
| Cr-0.15 Fe-1 $La_2O_3$ | 2.8 |
| Cr-24 Fe-5 Al-1 $Y_2O_3$ | 3.2 |

This shows that the alloys according to the invention have corrosion resistance which is up to twice as good as that of pure chromium.

Testing of the Heat Stability

To determine the heat stability properties of the alloys produced according to the invention, 3 mm thick sheets were produced and were tested for tensile strength and elongation at break at 1000° C.

| Material 3mm sheet | Tensile strength ($N/mm^2$) at 1000° C. | Elongation at break (%) 1000° C. | Ductile/ brittle transition temperature (°C.) |
|---|---|---|---|
| Cr | 40 | 62 | 365 |
| Cr-0.15 Fe-1 $Y_2O_3$ | 140 | 24 | 107 |
| Cr-0.15 Fe-1 $La_2O_3$ | 115 | 44 | 203 |
| Cr-24 Fe-5 Al-1 $Y_2O_3$ | 90 | 16.5 | not measured |

The substantially improved high-temperature tensile strength compared with pure chromium, in conjunction with a substantial reduction in the ductile/brittle transition temperature, is evident.

Testing of the Oxidation Resistance

To test the oxidation resistance of the alloys produced according to the invention in comparison with pure chromium, samples measuring 20 mm×30 mm were cut from the sheets produced according to the preparation example. The samples were then ground on both sides to a final thickness of 1 mm with removal of the superficial steel layers. After being weighed, the samples were oxidized in the air, once at a temperature of 1000° C. and once at a temperature of 1200° C., over a period of 7 days. At 1000° C., a firmly adhering oxide layer formed on the samples, so that the average weight increase of the samples was used as a measure of the oxidation resistance.

Moreover, the oxidation curve was determined at 1000° C. within an oxidation time of 112 hours, and the velocity constant was calculated therefrom. At 1200° C., an oxide layer formed on the samples which adhered only poorly and was removed by brushing and washing the samples in water, so that the average weight decrease of the samples was used as a measure of the oxidation resistance.

| Oxidation conditions: air at 1000° C. | | |
|---|---|---|
| Material | Weight increase after 168 hours ($grams/cm^2$) | Parabolic velocity constant $\frac{(grams)^2}{sec \cdot cm^4}$ |
| Cr | 3.3 | $1.9 \times 10^{-11}$ |
| Cr—0.15 Fe—1 $Y_2O_3$ | 1.3 | $2.8 \times 10^{-12}$ |
| Cr—0.15 Fe—1 $La_2O_3$ | 0.8 | $1.2 \times 10^{-12}$ |
| Cr—24 Fe—5 Al—1 $Y_2O_3$ | 2.0 | $8.0 \times 10^{-12}$ |

| Oxidation conditions: air at 1200° C. | |
|---|---|
| Material | Weight increase after 168 hours ($grams/cm^2$) |
| Cr | 14 |
| Cr—0.15 Fe—1 $Y_2O_3$ | 3 |
| Cr—0.15 Fe—1 $La_2O_3$ | 6 |
| Cr—24 Fe—5 Al—1 $Y_2O_3$ | 2 |

The substantially improved oxidation resistance of the alloy according to the invention compared with pure chromium is evident.

We claim:

1. A chromium-based alloy which has a chromium content of more than 65% by weight of said alloy and further comprising:

an oxide component comprising yttrium oxide and lanthanide oxide in the range of 0.005 to 5% by weight of said alloy and dispersed within the chromium alloy by a sintering process;

a first metal component selected from the group consisting of iron, nickel and cobalt in the range of 0.1 to 32% by weight of said alloy;

a second metal component selected from the group consisting of aluminum, titanium, zirconium and hafnium in an amount up to 30% by weight of said alloy;

a third metal component selected from the group consisting of vanadium, niobium, molybdenum, tantalum, tungsten and rhenium in an amount up to 10% by weight of said alloy; and one or more elements selected from the group consisting of carbon, nitrogen, boron and silicon in an amount up to 1% by weight of said alloy.

2. A chromium-based alloy as claimed in claim 1, wherein said first metal component is selected from the group consisting of iron and nickel in the range of 5 to 25% by weight of said alloy.

3. A chromium-based alloy as claimed in claim 1 wherein said second metal component is selected from the group consisting of aluminum, titanium and zirconium in the range of 3 to 10% by weight of said alloy.

4. A chromium-based alloy as claimed in claim 1, wherein said third metal component is selected from the group consisting of vanadium, niobium and molybdenum in the range of 3 to 10% by weight of said alloy.

5. A chromium-based alloy as claimed in claim 1, wherein said one or more elements from the group carbon nitrogen boron and silicon in the range of 0.03 to 0.3% by weight of said alloy.

6. A chromium-based alloy, strengthened by canning and hot-working the alloy after sintering, composed of 24% by weight of iron, 5% by weight of aluminum and by weight of aluminum and 1% weight of yttrium oxide, the remainder being chromium.

7. A powder metallurgical process for the preparation of a chromium-based alloy as claimed in claim 1, comprising the following steps:

compressing a mixture of starting powders comprising the components of said alloy to a minimum density of 60% to form a compact; and sintering the compact at a sinter temperature in a temperature range between 1500 and 1600° C. under an $H_2$ atmosphere during a period in the range of 15 to 20 hours.

8. A chromium-based alloy which has a chromium content of more than 65% by weight of said alloy and further comprising:

a component comprising lanthium oxide in the range of 0.005 to 5% by weight of said alloy and dispersed within the chromium alloy by a sintering process;

a first metal component selected from the group consisting of iron, nickel and cobalt in the range of 0.1 to 32% by weight of said alloy;

a second metal component selected from the group consisting of aluminum,titanium, zirconium and hafnium in an amount up to 30% by weight of said alloy;

a third metal component selected from the group consisting of vanadium, niobium, molybdenum, tantalum, tungsten and rhenium in an amount up to 10% by weight of said alloy; and one or more elements selected from the group consisting of carbon, nitrogen, boron and silicon in an amount up to 1% by weight of said alloy.

9. A chromium-based alloy which has a chromium content of more than 65% by weight of said alloy and further comprising:

an oxide component comprising yttrium oxide and lanthanum oxide in the range of 0.005 to 5% by weight of said alloy and dispersed within the chromium alloy by a sintering process;

a first metal component selected from the group consisting of iron, nickel and cobalt in the range of 0.1 to 32% by weight of said alloy;

a second metal component selected from the group consisting of aluminum, titanium, zirconium and hafnium in an amount up to 30% by weight of said alloy;

a third metal component selected from the group consisting of vanadium, niobium, molybdenum, tantalum, tungsten and rhenium in an amount up to 10% by weight of said alloy; and one or more elements selected from the group consisting of carbon, nitrogen, boron and silicon in an amount up to 1% by weight of said alloy.

10. A chromium-based alloy, strengthened by canning and hot-working the alloy after sintering wherein the sintering of the alloy occurs at about 1600° C. for a period of about 20 hours under a hydrogen atmosphere, which has a chromium content of more than 65% by weight of said alloy and further comprising:

an oxide component selected from the group consisting of yttrium oxide and lanthanide oxide in the range of 0.005 to 5% by Weight of said alloy and dispersed within the chromium alloy by sintering;

a first metal component selected from the group consisting of iron, nickel and cobalt in the range of 0.1 to 32% by weight of said alloy;

a second metal component selected from the group consisting of aluminum, titanium, zirconium and hafnium in an amount up to 30% by weight of said alloy;

a third metal component selected from the group consisting of vanadium, niobium, molybdenum, tantalum, tungsten and rhenium in an amount up to 10% by weight of said alloy; and one or more elements selected from the group consisting of carbon, nitrogen, boron and silicon in an amount UP to 1% by weight of said alloy.

11. A chromium-based alloy, strengthened by canning and hot-working the alloy after sintering wherein the hot-working of the alloy occurs in a plurality of process cycles, each cycle having a hot-working temperature of about 1250° C., a degree of deformation per run greater than 35 percent and being followed by a cooling process to room temperature, which has a chromium content of more than 65% by weight of said alloy and further comprising:

an oxide component selected from the group consisting of yttrium oxide and lanthanide oxide in the range of 0.005 to 5% by weight of said alloy and dispersed within the chromium alloy by sintering;

a first metal component selected from the group consisting of iron, nickel and cobalt in the range of 0.1 to 32% by weight of said alloy;

a second metal component selected from the group consisting of aluminum, titanium, zirconium and hafnium in an amount up to 30% by weight of said alloy;

a third metal component selected from the group consisting of vanadium, niobium, molybdenum, tantalum, tungsten and rhenium in an amount up to 10% by weight of said alloy; and one or more elements selected from the group consisting of carbon, nitrogen, boron and silicon in an amount up to 1% by weight of said alloy.

* * * * *